US009951960B2

(12) United States Patent
Spanò

(10) Patent No.: US 9,951,960 B2
(45) Date of Patent: Apr. 24, 2018

(54) METHOD OF OPERATING A GAS BURNER OF A GAS COOKING APPLIANCE AND GAS BURNER AND GAS COOKING APPLIANCE

(71) Applicant: Electrolux Appliances Aktiebolag, Stockholm (SE)

(72) Inventor: Fabio Spanò, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 227 days.

(21) Appl. No.: 14/768,307

(22) PCT Filed: Feb. 5, 2014

(86) PCT No.: PCT/EP2014/052243

§ 371 (c)(1),
(2) Date: Aug. 17, 2015

(87) PCT Pub. No.: WO2014/135328

PCT Pub. Date: Sep. 12, 2014

(65) Prior Publication Data

US 2016/0003483 A1 Jan. 7, 2016

(30) Foreign Application Priority Data

Mar. 8, 2013 (EP) ..... 13158352

(51) Int. Cl.
*F24C 3/12* (2006.01)
*F23N 1/00* (2006.01)
*F23N 5/20* (2006.01)

(52) U.S. Cl.
CPC ..... *F24C 3/126* (2013.01); *F23N 1/002* (2013.01); *F23N 1/005* (2013.01); *F23N 5/203* (2013.01);
(Continued)

(58) Field of Classification Search
CPC .. F23C 3/126; F23C 3/182; F24N 1/00; F24N 1/005; F23D 2208/00; F23N 2037/10
(Continued)

(56) References Cited

U.S. PATENT DOCUMENTS 8,845,326 B2 * 9/2014 Shaffer ..... F23D 14/06 126/39 E
2007/0163568 A1 * 7/2007 Murray ..... A47J 37/0713 126/50
(Continued)

FOREIGN PATENT DOCUMENTS

CN 101243288 A 8/2008
CN 102066841 A 5/2011
(Continued)

OTHER PUBLICATIONS

Office action issued in Chinese patent application No. 201480012005.4, dated May 5, 2017, 16 pages (with translation).
(Continued)

*Primary Examiner* — Vivek Shirsat
(74) *Attorney, Agent, or Firm* — Pearne & Gordon LLP

(57) ABSTRACT

A gas burner (2) including a gas injector (3), a gas supply line (4) connected to the gas injector (3) so as to feed gas to the gas injector (3), and a single automatic gas valve (5) installed in the gas supply line (4) upstream the gas injector (3) so as to control gas supply to the gas injector (3). During ordinary operational modes, the single automatic gas valve always is in an open status not exceeding a preset upper opening limit. During temporary boost operational modes the automatic gas valve is in an open state exceeding the upper opening limit.

11 Claims, 3 Drawing Sheets

(52) U.S. Cl.
CPC ..... *F24C 3/12* (2013.01); *F23N 2037/10* (2013.01); *F23N 2039/04* (2013.01); *F23N 2041/08* (2013.01)

(58) Field of Classification Search
USPC ..... 431/12, 69–72; 126/39 E, 39 R
See application file for complete search history.

(56) References Cited

U.S. PATENT DOCUMENTS

| | | | | |
|---|---|---|---|---|
| 2008/0216810 | A1* | 9/2008 | Clauss | F23N 1/005 126/42 |
| 2010/0116224 | A1* | 5/2010 | Leeland | F24H 9/2035 122/14.21 |

FOREIGN PATENT DOCUMENTS

| | | | |
|---|---|---|---|
| DE | 10 2011 006736 | A1 | 10/2012 |
| DE | 102011006736 | A1 | 10/2012 |
| WO | 2007/020189 | A1 | 2/2007 |
| WO | 2009/040243 | A2 | 4/2009 |

OTHER PUBLICATIONS

Office action issued in corresponding Chinese Patent Application No. 201480012005.4 dated Sep. 19, 2016, 6 pages, with English translation, 9 pages.
International Search Report issued in Application No. PCT/EP2014/052243 dated May 15, 2014.

* cited by examiner

METHOD OF OPERATING A GAS BURNER OF A GAS COOKING APPLIANCE AND GAS BURNER AND GAS COOKING APPLIANCE

The present application is directed to a method of operating a gas burner of a gas cooking appliance, to a gas burner and to a gas cooking appliance.

Gas burners, in particular gas hobs, of gas cooking appliances are widely known. With known gas burners or hobs, convenient ordinary operational modes are available. However, it would be desirable to improve operational modes and to provide more convenient modes of operation.

Therefore, it is an object of the invention to provide enhanced gas cooking appliances and gas burners, in particular gas hobs, as well as methods of operating the same. In particular possibilities for more convenient operating gas burners of gas cooking appliances, in particular for speeding up cooking processes, shall be provided.

This object in particular is achieved by claims 1, 10 and 12. Embodiments of the invention result from respective dependent claims.

According to claim 1, a method of operating a gas burner of a gas cooking appliance is provided. The gas burner or cooking appliance may be of domestic or industrial, i.e. professional, type. The gas burner to be operated according to the proposed method comprises a gas injector, in particular a single gas injector, a gas supply line, in particular a single gas supply line, connected to the gas injector so as to feed gas to the injector, and a single automatic gas valve installed in the gas supply line upstream the gas injector so as to control gas supply to the gas injector.

In other words, the gas cooking appliance comprises a gas injector and a single automatic gas valve, and a gas supply line at least between the automatic gas valve and the gas injector. The gas injector may be related to a burner of the gas cooking appliance and be adapted to release gas at the burner.

In ordinary operation, gas released by the gas injector at the burner is ignited, which results in a flame suitable for heating cookware, such as pots and pans.

The term "single automatic gas valve" in particular shall mean that the "automatic gas valve" is adapted and designed such that gas supply to the gas injector during all operational modes of the gas burner can be exclusively controlled by the single automatic gas valve. In particular, several parallel gas valves respectively connected to gas lines and being able to simultaneously control the gas flow to the gas injector shall not be construed under the term "single automatic gas valve". However, safety valves and the like can be installed in the gas supply line up- and/or downstream of the single automatic gas valve.

Further, the term automatic valve in particular shall mean that operational states of the valve can be set electronically, in particular with an electronic controller or control unit, if required with the aid of electronic actuators.

Preferably, the gas supply line is a single gas supply line, at least in a section between a gas outlet of the automatic gas valve and an inlet of the gas injector. The term single gas supply line in particular shall mean that the gas supply line comprises only a single branch, in particular in between the automatic gas valve and the gas injector.

Preferably, the gas burner comprises a single automatic gas valve connected to the single gas injector by a single gas supply line. In other words, the gas supply conduit to the gas injector is implemented as a single-stranded ducting with an individual or discrete, i.e. single, automatic gas valve installed in the ducting and adapted to exclusively control gas supply to the gas injector during operational modes of the gas burner.

According to claim 1 it is provided, that during ordinary operational modes, the single automatic gas valve always is in an opening status not exceeding a preset upper opening limit. This in particular means that the automatic valve is always in a partially opened state, without exceeding a preset upper opening state. In ordinary operational modes, the automatic valve therefore is not opened any further than the upper opening limit.

Ordinary operational modes shall be understood to be represented by the ordinary power levels or power modes provided for continued operation of the gas burner. Valve positions allowed for the ordinary operational modes reach up to the upper opening limit, which in turn means that the upper opening limit defines the range of allowable ordinary operational modes.

In claim 1 it is further provided that during a non-ordinary operational mode, in more detail during a temporary boost operational mode, the automatic gas valve is in an opening status exceeding the upper opening limit. This means that the automatic gas valve in the boost operational mode is opened further than the upper opening limit. In a preferred variant, the automatic gas valve in the boost operational mode is fully opened.

The method of operating the gas burner as set out above has the advantage that an additional boost mode can be implemented in a comparatively simple construction and without undue effort. In particular, comparatively effective and powerful electronic, preferably software-based, methods of controlling the power-levels of the gas burner, including ordinary operational modes and boost operational modes, can be used. It shall be noted that respective control methods are comparatively easy to be implemented without requiring extensive constructional efforts. The boost modes in particular enable speeding-up cooking processes.

In an embodiment of the method, the gas injector has a predefined and fixed gas flow rate. This in particular shall mean, that the gas injector does not have elements for adjusting the maximal gas flow rate, i.e. that the gas injector is free of gas flow adjusting elements. In this embodiment it is provided that during a boost operational mode, the overall gas flow rate is limited, i.e. defined, by the maximal gas flow rate of the gas injector.

As described above, the flow rate of the automatic gas valve is variable, i.e. adjustable, and during ordinary operational modes the overall gas flow rate is adjusted and limited by setting a respective opening state of the automatic gas valve. In the boost operational mode, however, the automatic gas valve is opened beyond the upper opening limit, preferably to the fully opened state. This means, that in the boost operational mode, the maximal gas flow rate preferably is exclusively dependent on the flow rate of the gas injector. This in general requires that the maximal gas flow rate of the automatic gas valve is larger than the maximal gas flow rate of the gas injector. Using the gas injector to define or fix the gas flow rate in the boost operational mode has the advantage of reduced control complexity. In the simplest mode, the boost operational mode, in more detail a respective boost gas flow rate, is automatically obtained upon fully opening the automatic gas valve.

In an embodiment, it is provided that setting operational modes of the automatic gas valve is carried out by a controller, in particular an electronic control unit. This aspect has already m been mentioned further above. However, using a controller and where applicable in combination with a suitable actuator adapted to set opening states of the gas valve allows to control the gas burner, which may be a gas hob, in a semi-automatic or even full automatic manner.

In an embodiment of the method, it is provided that the gas burner is operable in ordinary operational mode with a continuous power of an upper power limit. This shall mean that the gas burner can be operated in constant mode, i.e. can be constantly operated, in or at the upper power limit. In the temporary boost operational mode, the power of the gas burner is temporarily raised by a certain percentage, such as for example 25%, of the upper power limit. In other words, the gas burner is designed and dimensioned such that it can be operated in the boost mode with a power output higher than the 100% continuous power output, in particular with 125% of the continuous power output.

In an example, the continuous upper power limit may be in the range of about 4 kW. Taking the continuous upper power limit of 4 kW, a 125% raised boost power is about 5 kW.

The power of the gas burner may be adjustable in several power levels, wherein the continuous upper power limit may correspond to power level "9" and the lower power limit may correspond to level "1". It shall be noted, that operating the gas burner at the continuous upper power limit represents an ordinary operational mode of the gas burner. Therefore, the gas flow rate at the upper power limit is still controlled by the automatic gas valve, and not by the maximal gas flow rate of the gas injector.

In a further embodiment, the boost operational mode is blocked, or inhibited, for a fixed first time period after igniting the gas burner. Here, so called flame lift conditions, which are known as unstable burner conditions, can be prevented at least in the warming up phase of the gas burner.

According to a further embodiment, a maximal duration of the boost operational mode is restricted to a fixed second time period. The second time period may be selected such that accelerated heat-up from the cold state to the ordinary operational temperature is possible, without exceeding the overload capability, in particular the thermal overload capability, of the gas cooking appliance.

In a further embodiment, it is required that two successive boost operational modes require an intermediate ordinary operational mode at least of a fixed third time period. The fixed third time period may be selected such that thermal overload of the gas burner can greatly be avoided, in particular in cases in which several intermittent yet subsequent boost operational modes are executed.

In a further embodiment of the method it is provided that the gas burner, and therefore gas cooking appliance, in a further operational mode is powered in an intermittent mode successively alternating between ordinary operational and boost operational modes. Such an operational mode may in particular be allowed for a certain time period, in which the gas burner may in average be operated at a power level somewhat higher than the continuous upper power limit. As such exceptional modes in general are comparatively rare, the thermal load, service life and lifetime of the gas burner are scarcely impaired.

According to claim 10, a gas burner is provided, which comprises a gas injector with a fixed maximal gas flow rate, a single automatic gas valve, and a gas supply line, in particular a single stranded gas supply line, at least connecting a gas output of the automatic valve to a gas input of the gas injector. The gas supply line in particular is adapted such that gas can be supplied or fed from the automatic gas valve to the gas injector.

The gas burner, in particular part of a gas cooking appliance of domestic or industrial type, is implemented such that a maximal flow rate of the single automatic valve is larger than a maximal flow rate of the gas burner. Here, boost operational modes can be implemented by fully opened states of the automatic gas valve, whereas ordinary operational modes can be implemented by partially opened states of the automatic gas valve. Reference in particular is made to the description above in which respective operational modes of the gas burner have been described and which apply mutatis mutandis.

In a possible embodiment of the gas burner, an electronic control unit is provided. The electronic control unit is adapted to control open and closing positions of the automatic gas valve according to any of the methods and method variants as described further above. In particular, the control unit can operate the automatic gas valve so as to obtain ordinary operational modes and boost operational modes. Further, the control unit may operate the automatic gas valve to obtain the intermittent operational mode. Further, the control unit may operate the gas burner by utilizing the first to third time limits and so on.

Embodiments of the invention will now be described in connection with the annexed figures, in which FIG. 1 shows a schematic design of a proposed gas burner;

The invention will be described in connection with selected embodiments of a gas burner, wherein the selected embodiments shall not be construed as limiting the scope of the invention.

If not otherwise stated like elements are denoted by like reference signs throughout the figures. The figures may not be true to scale, and scales of different figures may be different.

Figure 1:
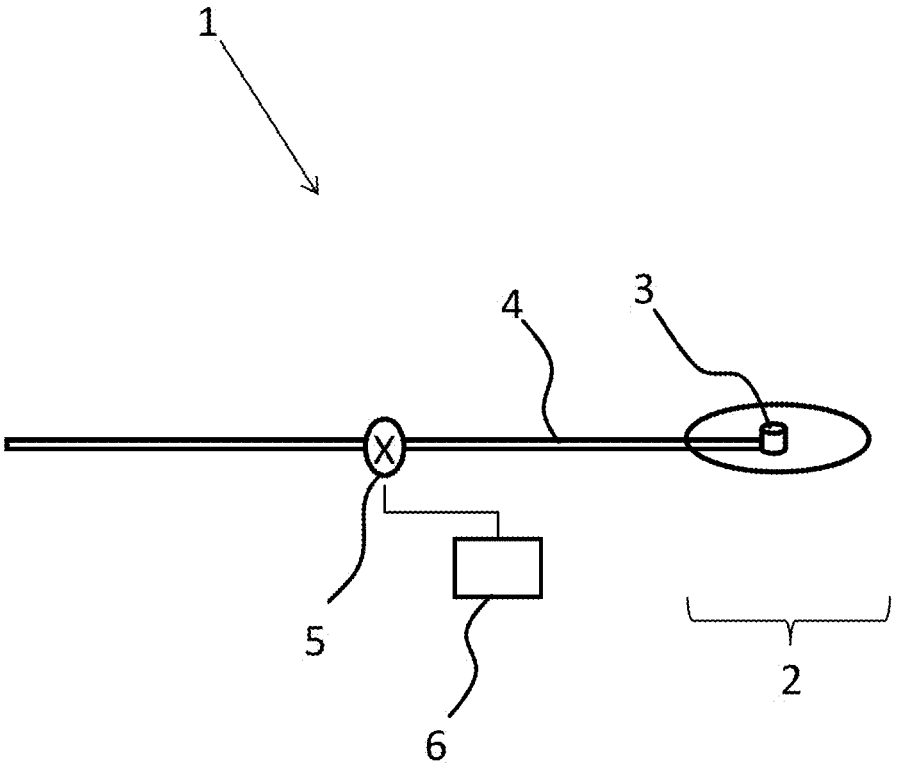

FIG. 1 shows a schematic design of a gas cooking appliance 1 according to the invention. The gas cooking appliance 1 comprises a gas burner 2 with a gas injector 3. The gas injector 3 is connected via a single stranded gas supply line 4 to an automatic gas valve 5. It shall be noted, that the gas cooking appliance 1 may comprise more than just one gas burner 2. In particular, the gas cooking appliance 1 may comprise two, three or four gas burners 2 as shown and described in connection with FIG. 1.

Going now into details of the gas burner 2, a gas outlet of the automatic gas valve 5 is connected to a gas inlet of the gas injector 3 via a single gas supply line, in particular a single stranded gas supply line. This in particular shall mean that the ducting via the automatic gas valve 5 is the only possibility to feed or supply gas to the gas injector 3 or gas burner 2. There are no bypass gas lines or additional bypass gas valves allowing gas supply to the gas burner 2.

A gas supply line connected to the automatic gas valve 5 for the purpose of feeding gas from a reservoir to the automatic gas valve 5 in the present case is also implemented as a single stranded gas supply line. However, it is possible that several gas supply lines are provided for supplying gas to the automatic gas valve 5. For the present embodiment it is of importance, that the connection between the single automatic gas valve 5 and the single gas injector 3 is implemented as a single gas supply line 4. This in particular has the advantage, that all operational modes of the gas burner 2 can be set, adjusted or controlled by adequately setting the state of the automatic gas valve 5.

For setting respective operational modes of the automatic gas valve 5, the automatic gas valve 5 is connected to a control unit 6. The control unit 6 is adapted to set respective suitable opening states of the automatic gas valve 5. If required, an actuator (not shown) may be provided, adapted to actively set respective operational modes of the automatic gas valve 5.

The control unit 6 in particular is adapted such that any of the above identified methods can be conducted.

Figure 2:
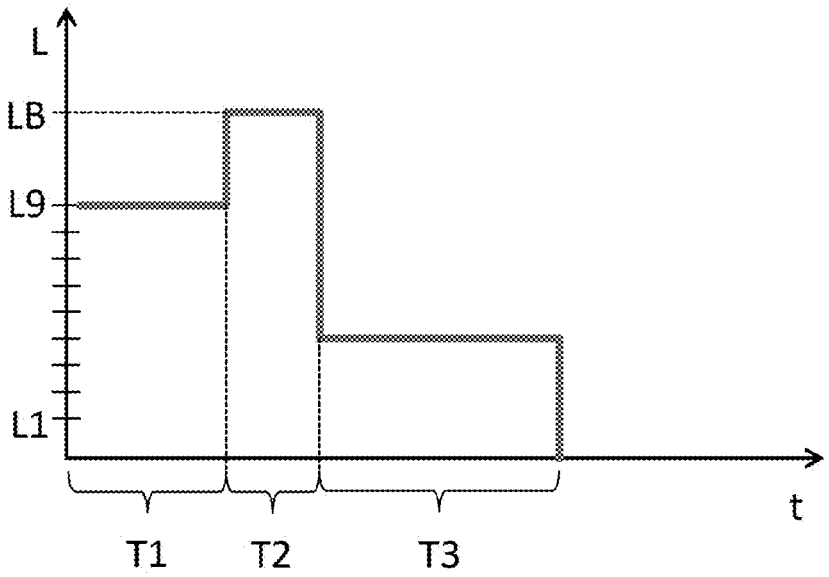
FIG. 2 shows a chart of a first operational mode.

One exemplary method or operational mode that may be executed with the present gas burner 2 is schematically shown in the chart of FIG. 2.

In the chart shown in FIG. 2 the course of flame level L is plotted against time t. After ignition (t=0), the gas burner 2 is operated at flame level L9, which corresponds to an ordinary operational mode of the gas burner 2. The other flame levels L1 to L8 also correspond to respective discrete ordinary operational modes of the gas burner 2. The flame level L9 in the present case is the highest flame level available for ordinary operational modes and the highest flame level in which the gas burner 2 can be operated continuously.

After a first time period T1, which may be a preset period of time, the gas burner 2 is switched to a boost operational mode with a respective boost flame level LB. The boost flame level LB is higher than the maximal flame level L9. The boost flame level LB may be 125% of L9. The flame level L9 may for example correspond to an output power of 4 kW. In this case, the 125% boost output power is about 5 kW. Note that operation in boost mode in particular shall mean to operate the gas burner 2 at a power level higher than 100% of the possible continuous power output.

The boost flame level LB is maintained for a second time period T2. The second time period T2 may be a maximal, preset time period allowed for the gas burner 2 to be operated in boost mode. Using the boost function, heating up of the cold gas burner 2 or reheating the gas burner 2 to a desired heat level can greatly be speeded up. The second time period may for example lie in the range of about 3 minutes.

In the boost mode, the automatic gas valve 5 is driven to the fully opened state. As the maximal gas flow rate of the automatic gas valve 5 is larger than that of the gas injector 3, the overall gas flow rate is fixed by the maximal flow rate of the gas injector 3. Setting the absolute, maximal gas flow rate by properties of the gas injector 3 may simplify operation and control of the gas burner flame levels.

After the boost operational mode in the second time period T2, in particular after the maximal allowable boost time, the control unit 6 drives the automatic gas valve 5 to a lower flame level, such as flame level L4 for example, in which for the duration of a third time period T3 an ordinary cooking operation may be performed. After the third time period T3, i.e. after having finished the cooking operation, the automatic gas valve 5 may be driven to flame level 0, corresponding to the off state of the gas burner 2.

As may be recognized, the boost functionally as proposed herein can be implemented in an easy way and without great effort, in particular constructional effort. Further, comparatively short response times and uncomplicated, in particular software-based, control of the automatic gas valve 5 is possible.

Figure 3:
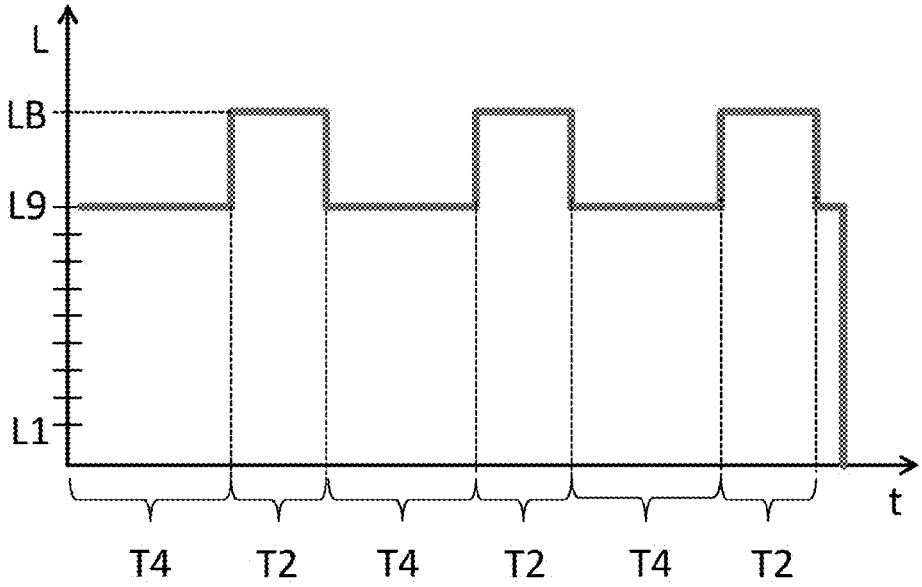
FIG. 3 shows a chart of a second operational mode.

FIG. 3 shows a further operational mode of the gas burner 2. In this operational mode, the gas burner 2 is operated in an intermittent mode. In this mode, an initial ordinary operational mode at flame level L9 over a fourth time period T4 is followed by a boost operational mode over the time period T2. This sequence of non-boost and boost operational mode is repeated several times, and finally the flame level is set to flame level L0 in which the automatic gas valve 5 is closed. In this operational mode, the gas burner 2 can be operated with slightly enhanced power output, i.e. with a power output slightly above the nominal continuous power output.

The boost mode may be conducted over the time period T2, which may be the maximal allowable time for boost operation. It shall be noted, that any other time intervals may be utilized. In between two boost operational modes, conventional or ordinary operational modes are carried out. The ordinary operational modes are adjusted and adapted such that overheating of the gas burner 2 despite operation in boost mode for an elongated period can be prevented. For operating the gas burner 2 in the intermittent mode, as shown in FIG. 3, the automatic gas valve 5 may be switched between the fully opened state and the partially closed state corresponding to the flame level L9. It shall be noted that other flame levels may be used in intermittent mode, in particular in dependence of the intended overall output power and allowable boost time and thermal loads.

In all, it can be seen that the proposed gas burner 2 can be operated and controlled in a comparatively simple and easy way. Further, the gas burner 2 can be implemented with corresponding low constructional effort.

LIST OF REFERENCE NUMERALS

1 gas cooking appliance
2 gas burner
3 gas injector
4 gas supply line
5 automatic gas valve
6 control unit
L flame level
t time
T1 first time period
T2 second time period
T3 third time period
T4 fourth time period

What is claimed is:

1. A method of operating a gas burner of a gas cooking appliance, the cooking appliance comprising: a gas injector, a gas supply line connected to the gas injector so as to feed gas to the gas injector, and a single automatic gas valve installed in the gas supply line upstream from the gas injector so as to control gas supply to the gas injector; the method comprising, during ordinary operational modes, maintaining the single automatic gas valve always in an opened state not exceeding a preset upper opening limit, wherein during a temporary boost operational mode the automatic gas valve is in an opened state exceeding the upper opening limit, and wherein the boost operational mode is blocked for a fixed first time period after igniting the gas burner.

2. The method according to claim 1, wherein the gas injector has a predefined and fixed maximal gas flow rate, and wherein during the boost operational mode, the overall gas flow rate is limited by the fixed maximal flow rate of the gas injector.

3. The method according to claim 1, wherein setting the respective operational modes of the automatic gas valve is carried out by an electronic control unit.

4. The method according to claim 1, wherein the gas burner is operable in said ordinary operational modes with a continuous power having an upper power limit corresponding to said upper opening limit, and wherein in the temporary boost operational mode, the power of the gas burner is temporarily raised by a certain percentage of the upper power limit.

5. The method according to claim 4, wherein the continuous upper power limit is about 4 kW.

6. The method according to claim 1, wherein a maximal duration of the boost operational mode is restricted to a fixed second time period.

7. The method according to claim 1, wherein two successive boost operational modes require an intermediate ordinary operational mode at least of a fixed third time period.

8. The method according to claim 1, wherein the gas burner in a further operational mode is powered in an intermittent mode successively alternating between ordinary operational and boost operational modes.

9. A gas burner comprising:

a gas injector with a fixed maximal gas flow rate;

a single automatic gas valve;

a gas supply line at least connecting a gas output of the automatic valve to a gas input of the gas injector, wherein a maximal gas flow rate of the automatic valve is larger than the maximal flow rate of the gas injector; and an electronic control unit adapted to control open and closing positions of the automatic gas valve wherein during ordinary operational modes, the single automatic gas valve is always in an opened state not exceeding a preset upper opening limit, and wherein during a temporary boost operational mode the automatic gas valve is in an opened state exceeding the upper opening limit, wherein the boost operational mode is blocked for a fixed first time period after igniting the gas burner.

10. A gas cooking appliance comprising at least one gas burner according to claim 9.

11. The method according to claim 4, wherein the certain percentage is 25% of the upper power limit.

* * * * *